US010028602B1

(12) United States Patent
Johnson

(10) Patent No.: US 10,028,602 B1
(45) Date of Patent: Jul. 24, 2018

(54) BEVERAGE CONTAINER SECURITY COVER

(71) Applicant: Mary Johnson, St. Petersburg, FL (US)

(72) Inventor: Mary Johnson, St. Petersburg, FL (US)

( * ) Notice: Subject to any disclaimer, the term of this patent is extended or adjusted under 35 U.S.C. 154(b) by 0 days.

(21) Appl. No.: 15/370,007

(22) Filed: Dec. 6, 2016

(51) Int. Cl.
*A47G 19/22* (2006.01)
*B65D 79/02* (2006.01)

(52) U.S. Cl.
CPC ..... *A47G 19/2227* (2013.01); *B65D 79/02* (2013.01)

(58) Field of Classification Search
CPC ..... A47G 19/2227; A47G 19/2255; B65D 41/48; B65D 43/02; B65D 43/0214; B65D 43/0229; B65D 43/16; B65D 51/24; B65D 51/245; B65D 55/02; B65D 55/08; B65D 79/02
USPC .... 220/212.5, 214, 252, 315, 348, 351, 713, 220/815, 826; 206/813
See application file for complete search history.

(56) References Cited

U.S. PATENT DOCUMENTS

| | | | | |
|---|---|---|---|---|
| 5,740,940 | A | 4/1998 | Weiss | |
| 6,276,551 | B1 | 8/2001 | Miller, II | |
| D450,979 | S | 11/2001 | Nestro | |
| 7,979,973 | B2 | 7/2011 | Solazzi | |
| 8,100,287 | B2 | 1/2012 | Milnark | |
| 8,413,841 | B2 | 4/2013 | Cunningham | |
| 8,579,138 | B2 | 11/2013 | Jamison | |
| 2006/0231563 | A1 | 10/2006 | Olivar | |
| 2014/0061208 | A1 | 3/2014 | Boyd | |
| 2015/0166235 | A1 * | 6/2015 | Harding | A47G 19/2205 220/796 |

FOREIGN PATENT DOCUMENTS

| | | | | |
|---|---|---|---|---|
| EP | 0761556 A1 * | 3/1997 | | B65D 41/48 |
| GB | 2087368 A * | 5/1982 | | B65D 55/02 |
| GB | 2261427 A * | 5/1993 | | B65D 43/16 |
| GB | 2435035 A * | 8/2007 | | B65D 49/00 |
| WO | 2008033537 A2 | 3/2008 | | |

* cited by examiner

*Primary Examiner* — Bryon Gehman
(74) *Attorney, Agent, or Firm* — Kyle A. Fletcher, Esq.

(57) ABSTRACT

The beverage container cover is a disposable security cover that is placed over an open beverage container that contains a beverage. The beverage container cover is placed over the open beverage container for the purposes of: 1) protecting the contents contained within the open beverage container from being tampered with while the open beverage container is unattended; 2) provide a visual indication that indicates that an attempt was made to tamper with the contents contained within the beverage container. The beverage container cover comprises a shell and a locking mechanism. The shell is wrapped around the beverage container to prevent tampering with the contents of the beverage container. The locking mechanism is a permanent lock that once engaged cannot be disengaged. The beverage container cover is removed by removing a perforated tab that is formed within the shell of the beverage container cover.

14 Claims, 4 Drawing Sheets

BEVERAGE CONTAINER SECURITY COVER

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the field of containers for the storage and transport of materials, more specifically, an apparatus that encloses a beverage container that is released by tearing a wall portion of the apparatus.

SUMMARY OF INVENTION

The beverage container cover is a disposable security cover that is placed over an open beverage container that contains a beverage. The beverage container cover is placed over the open beverage container for the purposes of: 1) protecting the contents contained within the open beverage container from being tampered with while the open beverage container is unattended; 2) provide a visual indication that indicates that an attempt was made to tamper with the contents contained within the beverage container. The beverage container cover comprises a shell and a locking mechanism.

These together with additional objects, features and advantages of the beverage container cover will be readily apparent to those of ordinary skill in the art upon reading the following detailed description of the presently preferred, but nonetheless illustrative, embodiments when taken in conjunction with the accompanying drawings.

In this respect, before explaining the current embodiments of the beverage container cover in detail, it is to be understood that the beverage container cover is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the beverage container cover.

It is therefore important that the claims be regarded as including such equivalent construction insofar as they do not depart from the spirit and scope of the beverage container cover. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the appended claims.

DETAILED DESCRIPTION OF THE EMBODIMENT

Figure 1:
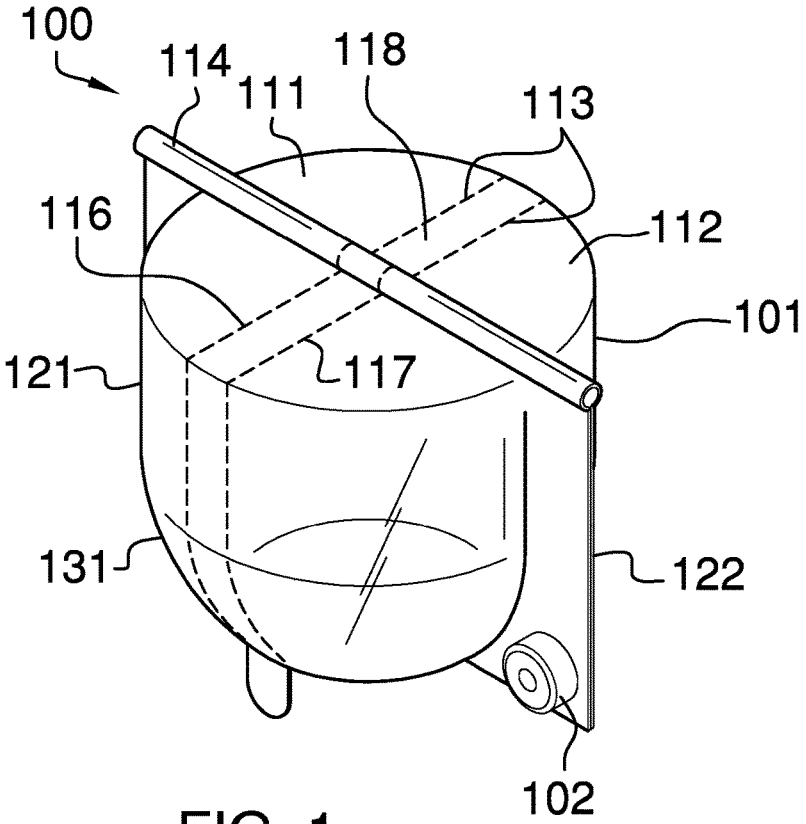
FIG. 1 is a perspective view of an embodiment of the disclosure.

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

Detailed reference will now be made to one or more potential embodiments of the disclosure, which are illustrated in FIGS. 1 through 6.

The beverage container cover 100 (hereinafter invention) is a disposable security cover that is placed over an open beverage container 161 that contains a beverage 162 (hereinafter contents). The invention 100 is placed over the open beverage container 161 for the purposes of: 1) protecting the contents 162 contained within the open beverage container 161 from being tampered with while the open beverage container 161 is unattended; 2) provide a visual indication that indicates that an attempt was made to tamper with the contents 162 contained within the beverage container 161. The invention 100 comprises a shell 101 and a locking mechanism 102. The shell 101 is wrapped around the beverage container 161 to prevent tampering with the contents 162 of the beverage container 161. The locking mechanism 102 is a permanent lock that once engaged cannot be disengaged. The invention 100 is removed by removing a perforated tab 113 that is formed within the shell 101 of the invention 100.

The shell 101 is formed as a single unit from molded plastic. The shell 101 is formed in a variety of shapes and sizes. Each shape and size is customized to fit a specific can, bottle, glass, or cup that is used as a beverage container 161.

The shell 101 comprises a first barrier 111, a second barrier 112, a perforated tab 113 and a hinge 114. As shown most clearly in FIG. 3, the first barrier 111 and the second barrier 112 are symmetric structures that are used to encase the beverage container 161. Specifically, when the first barrier 111 and the second barrier 112 are properly aligned along a symmetrical plane 115, the first barrier 111 and the second barrier 112 forms a negative space into which the beverage container 161 can be inserted and contained. Stated in a less formal fashion, the first barrier 111 and the second barrier 112 forms an exterior surface which can be placed around the beverage container 161 in such a manner that the beverage container 161 and the contents 162 are completely enclosed by the first barrier 111 and the second barrier 112.

Figure 2:
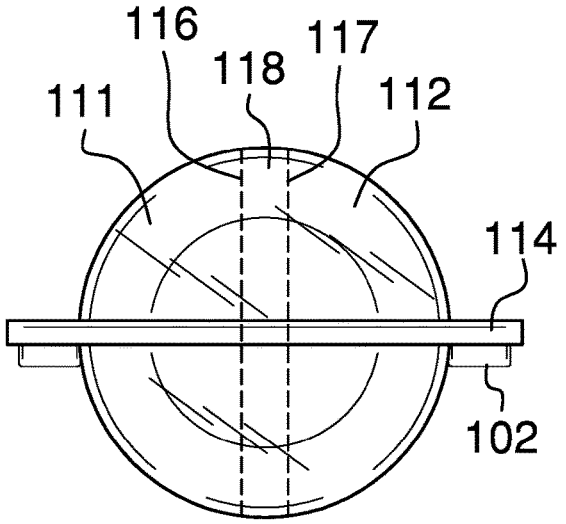
FIG. 2 is a top view of an embodiment of the disclosure.
Figure 3:
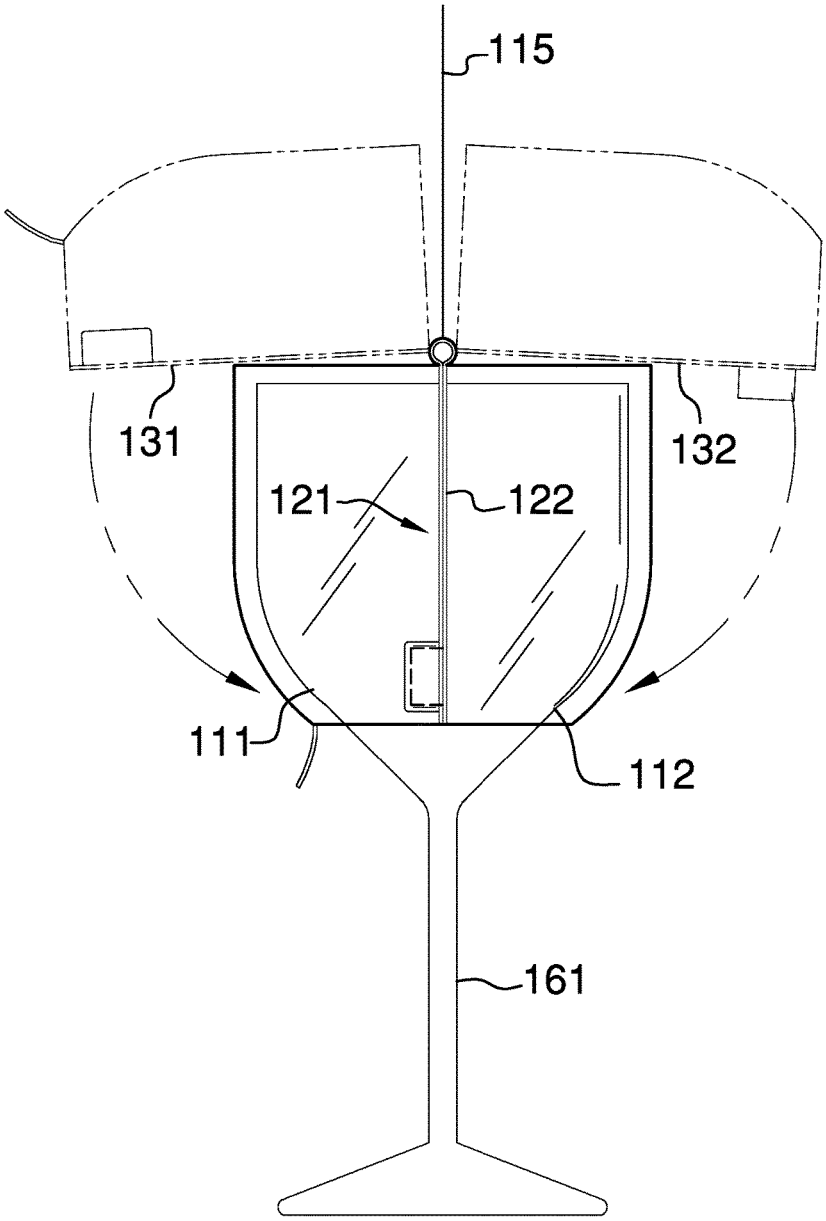
FIG. 3 is a side view of an embodiment of the disclosure.
Figure 4:
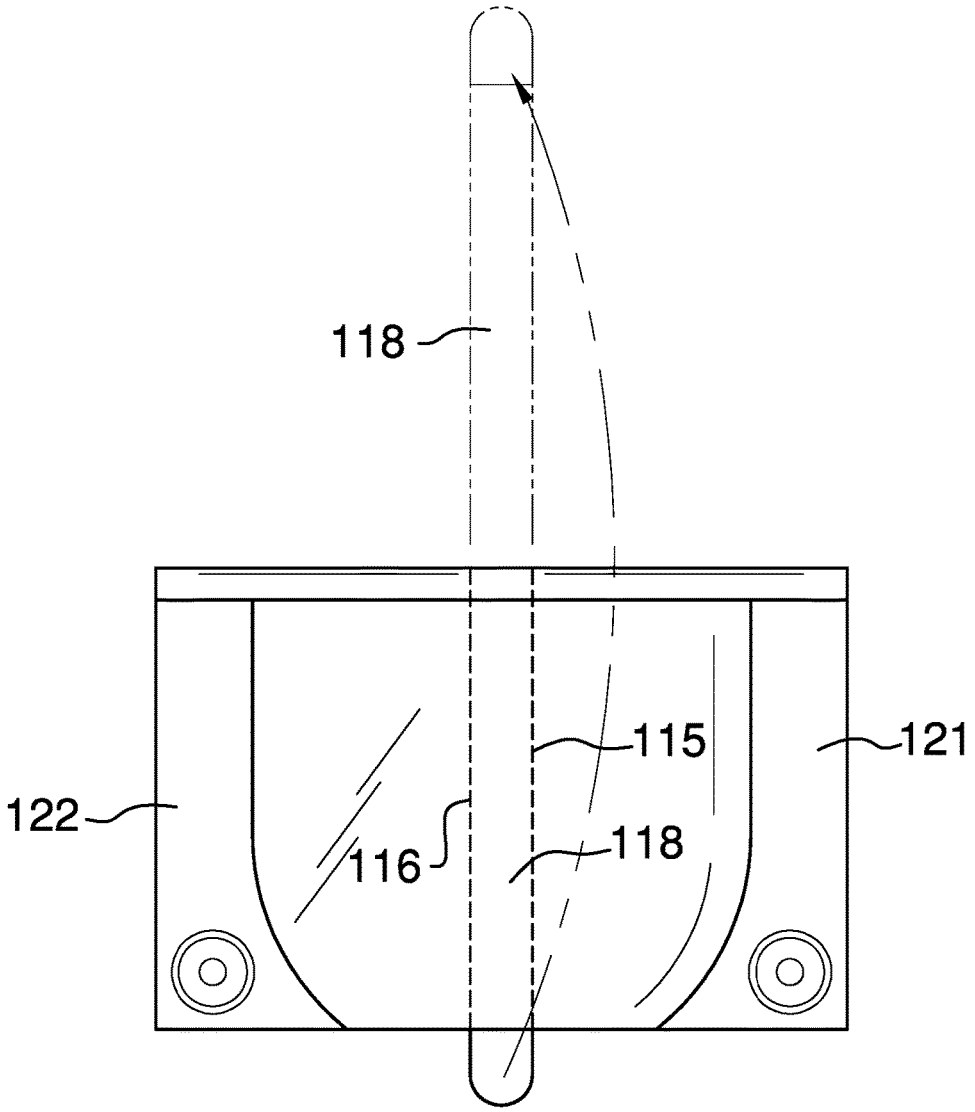
FIG. 4 is a front view of an embodiment of the disclosure.
Figure 5:
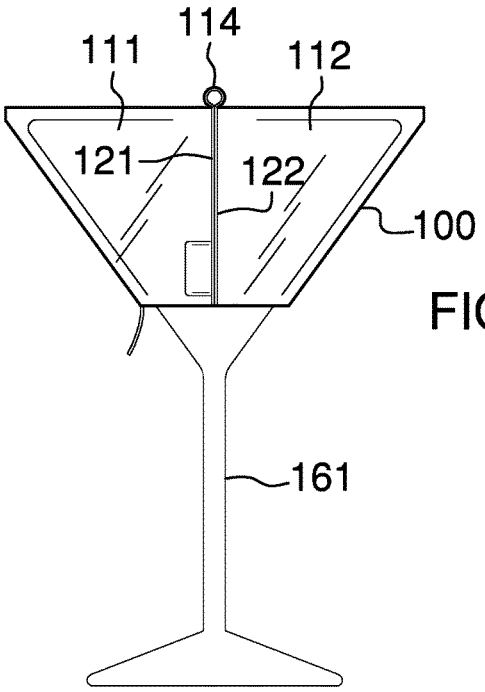
FIG. 5 is a side view of an alternate embodiment of the disclosure.
Figure 6:
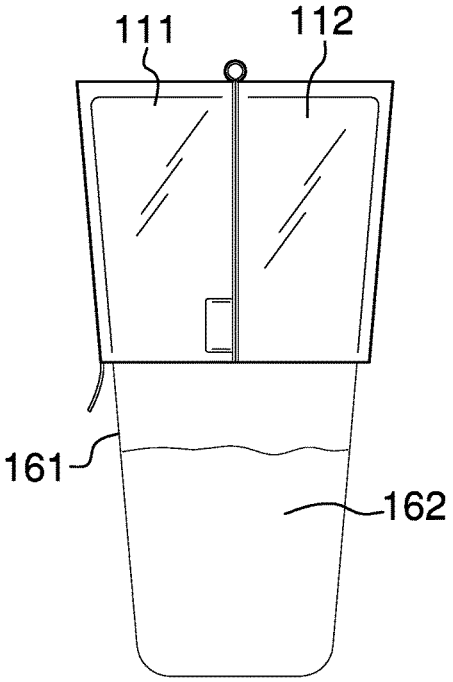
FIG. 6 is a side view of an alternate embodiment of the disclosure.

As shown most clearly in FIGS. 1 and 3, the hinge 114 is a pivoting structure that attaches the first barrier 111 and the second barrier 112 together such that: 1) the first barrier 111 will rotate towards and away from the symmetrical plane 115; and, 2) the second barrier 112 will rotate towards and away from the symmetrical plane 115. The perforated tab 113 comprises a first series of perforations 116 and a second series of perforations 117. The first series of perforations 116 forms a line that: 1) crosses the symmetrical plane 115 in a perpendicular manner; 2) forms a line across the first barrier 111; and 3) forms a line across the second barrier 112. The second series of perforations 117 forms a line that is parallel to the first series of perforations 116. As shown most clearly in FIGS. 1, 2, and 4, the first series of perforations 116 and the second series of perforations 117 forms a strip of material 118. When the strip of material 118 is pulled, the strip of material 118 tears away from the shell 101 in a non-replaceable manner such that access to the contents 162 of the beverage container 161 is gained in a highly visible manner. Methods to make perforations as described in this paragraph are well known and documented in the manufacturing arts.

As shown most clearly in FIGS. 1 and 2, the first barrier 111 further comprises a first wing 121. The second barrier 112 further comprises a second wing 122. The first barrier 111 extends beyond a first perimeter 131 formed by the open face of the first barrier 111 in a plane parallel to the plane formed by the symmetric plane 115. The second barrier 112 extends beyond a second perimeter 132 formed by the open face of the second barrier 112 in a plane parallel to the plane formed by the symmetric plane 115. The locking mechanism 102 is a fastener that attaches the first wing 121 to the second wing 122 such that the first barrier 111 is locked to the second barrier 112. In the first potential embodiment of the disclosure, the locking mechanism 102 is a ratchet based latching mechanism that allows only one direction of motion between a first latching object and a second latching object that associated with the latching mechanism that forms the fastener. Such unidirectional latching mechanism are well known and documented in the mechanical arts. Examples of such ratchet based latching mechanisms include, but is not limited to, readily and commercially available cable ties.

In the first potential embodiment of the disclosure, the invention 100 is formed as a single unit from molded plastic. Suitable plastics include, but are not limited to, polycarbonate, polyethylene, or poly(methyl methacrylic).

To use the first potential embodiment of the invention 100, the first barrier 111 and the second barrier 112 are wrapped around the beverage container 161. The beverage container 161 can then be safely left unattended. To resume consumption of the contents 162 of the beverage container 161, the strip of material 118 is removed from the shell 101 thereby releasing the beverage container 161.

The following definitions were used in this disclosure:

Cable Tie: As used in this disclosure, a cable tie is a type of fastener that is used to tie two objects together. The cable tie has a box end and an open end. The box end further comprises a gear like structure wherein when the open end is inserted into the gear like structure, the gear like structure acts as a ratchet that prevents the open end from being removed from the gear like structure.

Disposable: As used in this disclosure, disposable is an adjective that refers to an object that is designed and intended for a single use. Within this context, an object would be considered disposable if it is not reusable after its initial use.

Exterior: As used in this disclosure, the exterior is use as a relational term that implies that an object is not contained within the boundary of a structure or a space.

Fastener: As used in this disclosure, a fastener is a device that is used to join or affix two objects. Fasteners generally comprise a first element which is attached to the first object and a second element which is attached to the second object such that the first element and the second element join to affix the first object and the second object.

Form Factor: As used in this disclosure, the term form factor refers to the size and shape of an object.

Hinge: As used in this disclosure, a hinge is a device that permits the turning, rotating, or pivoting of a first object relative to a second object.

Interior: As used in this disclosure, the interior is use as a relational term that implies that an object is contained within the boundary of a structure or a space.

Latch: As used in this disclosure, a latch is a fastening or locking mechanism. The use of the term latch does not necessarily but often implies the insertion of an object into a notch or cavity.

Negative Space: As used in this disclosure, negative space is a method of defining an object through the use of open or empty space as the definition of the object itself, or, through the use of open or empty space to describe the boundaries of an object.

Perforation: A used in this disclosure, a perforation refers to a series of small holes that are formed in a material in such a way as to allow a portion of the material to be easily torn off. The material that contains the perforations is referred to as the perforated material.

Ratchet: As used in this disclosure, a ratchet is a device, often comprising a pawl or hinged catch that engages the sloping teeth of a wheel or bar, that permits motion in one direction only.

With respect to the above description, it is to be realized that the optimum dimensional relationship for the various components of the invention described above and in FIGS. 1 through 6 include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

What is claimed is:

1. A security device comprises:

security device is a disposable cover that is placed over an open beverage container;

wherein the security device provides a visual indication that an attempt was made to tamper with contents contained within the beverage container;

wherein the security device comprises a shell and a locking mechanism;

wherein the shell is wrapped around the beverage container;

wherein the locking mechanism is a lock that once engaged cannot be disengaged;

wherein the shell comprises a first barrier, a second barrier, a perforated tab and a hinge;

wherein the hinge joins the first barrier and the second barrier;

wherein the perforated tab is formed in the first barrier and the second barrier;

wherein the first barrier and the second barrier are symmetric structures;

wherein the first barrier and the second barrier encase the beverage container;

wherein the first barrier and the second barrier form a space into which the beverage container is inserted and contained;

wherein the hinge is a pivoting structure that attaches the first barrier and the second barrier together such that the first barrier will rotate towards and away from a symmetrical plane;

wherein the hinge is a pivoting structure that attaches the first barrier and the second barrier together such that the second barrier will rotate towards and away from the symmetrical plane;

wherein the perforated tab comprises a first series of perforations;

wherein the first series of perforations forms a line that crosses the symmetrical plane in a perpendicular manner;

wherein the first series of perforations forms a line across the first barrier;

wherein the first series of perforations forms a line across the second barrier.

2. The security device according to claim 1 wherein the first barrier further comprises a first wing;

wherein the second barrier further comprises a second wing;

wherein the first barrier extends beyond the open face of the first barrier in a plane parallel to the plane formed by the symmetric plane;

wherein the second barrier extends beyond the open face of the second barrier in a plane parallel to the plane formed by the symmetric plane.

3. The security device according to claim 2 wherein the locking mechanism is a fastener that attaches the first wing to the second wing;

wherein the locking mechanism locks the first barrier is locked to the second barrier.

4. The security device according to claim 3 wherein the locking mechanism is a ratchet based latching mechanism.

5. The security device according to claim 4 wherein the locking mechanism allows only one direction of motion within the latching mechanism.

6. The security device according to claim 1 wherein the perforated tab comprises a second series of perforations;

wherein the second series of perforations forms a line that is parallel to the first series of perforations.

7. The security device according to claim 6 wherein the first series of perforations and the second series of perforations forms the boundary of a strip of material.

8. The security device according to claim 7 wherein the strip of material tears away from the shell in a non-replaceable manner such that access to the contents of the beverage container is gained in a highly visible manner.

9. The security device according to claim 8 wherein the first barrier further comprises a first wing;

wherein the second barrier further comprises a second wing;

wherein the first barrier extends beyond the open face of the first barrier in a plane parallel to the plane formed by the symmetric plane;

wherein the second barrier extends beyond the open face of the second barrier in a plane parallel to the plane formed by the symmetric plane.

10. The security device according to claim 9 wherein the locking mechanism is a fastener that attaches the first wing to the second wing.

11. The security device according to claim 10 wherein the locking mechanism locks the first barrier to the second barrier.

12. The security device according to claim 11 wherein the locking mechanism is a ratchet based latching mechanism.

13. The security device according to claim 12 wherein the locking mechanism allows only one direction of motion within the latching mechanism.

14. The security device according to claim 13 wherein the security device is formed as a single unit from molded plastic.

* * * * *